US005931108A

United States Patent [19]

Scholl

[11] Patent Number: 5,931,108

[45] Date of Patent: Aug. 3, 1999

[54] PROCESS AND AUTOMATIC SEWING MACHINE FOR SEWING A FLAP WITH A ROUGH CLOSING EDGE AND A POCKET ON A FABRIC PART IN ONE OPERATION

[75] Inventor: Hans Scholl, Oerlingshausen, Germany

[73] Assignee: G.M. Pfaff Aktiengesellschaft, Kaiserslautern, Germany

[21] Appl. No.: 09/022,250

[22] Filed: Feb. 11, 1998

[30] Foreign Application Priority Data

Feb. 13, 1997 [DE] Germany ..... 197 05 314

[51] Int. Cl.[6] ..... D05B 21/00; D05B 35/00

[52] U.S. Cl. ..... 112/475.09; 112/470.16; 112/114

[58] Field of Search ..... 112/470.14, 470.16, 112/470.18, 470.07, 475.06, 475.09, 475.08, 104, 114, 147; 223/37

[56] References Cited

U.S. PATENT DOCUMENTS

| | | | |
|---|---|---|---|
| 4,785,749 | 11/1988 | Fischer . | |
| 4,793,272 | 12/1988 | Scholl et al. . | |
| 4,813,362 | 3/1989 | Vogt et al. . | |
| 4,843,985 | 7/1989 | Hiramatsu et al. | 112/147 |
| 5,272,994 | 12/1993 | Scholl et al. . | |
| 5,584,258 | 12/1996 | Castillo | 112/470.16 X |

FOREIGN PATENT DOCUMENTS

| | | |
|---|---|---|
| 37 09 210 A1 | 9/1988 | Germany . |
| 37 09 251 A1 | 9/1988 | Germany . |
| 37 09 264 A1 | 9/1988 | Germany . |
| 41 24 164 | 6/1993 | Germany . |

*Primary Examiner*—Peter Nerbun
*Attorney, Agent, or Firm*—McGlew and Tuttle, P.C.

[57] ABSTRACT

A preparation station including a fabric support plate, a folding plate and a positioning support for a flap of a flap pocket. The fabric part to which the pocket is to be connected, is supported by the fabric support plate. The flap, and possibly the pocket cut are lined at the preparation station. The pocket cut can also be placed into its folded position by the preparation station. The fabric part, with the pocket cut, if present, and the pocket flap are then moved by a fabric holder to a sewing machine with a sewing position. There, the pocket cut can be sewn onto the fabric part if desired. The pocket flap is in a rotated position, which is angularly spaced by approximately 180° from a final position of the pocket flap. The pocket flap can then be connected to the fabric part by a fastening seam. A turning strip turns over the flap, in cooperation with a folding strip, and another seam connects the flap to the fabric part in its final position. In another embodiment, the folding strip can hold the rough cut end of the pocket flap against the fabric part, and the turning strip turns the remainder of the flap into the final position, where the flap is connected to the fabric part by one or two seams.

30 Claims, 10 Drawing Sheets

PROCESS AND AUTOMATIC SEWING MACHINE FOR SEWING A FLAP WITH A ROUGH CLOSING EDGE AND A POCKET ON A FABRIC PART IN ONE OPERATION

FIELD OF THE INVENTION

The present invention pertains to a process for sewing a flap with rough closing edge and a pocket on a fabric part in one operation and to an automatic sewing machine for carrying out this process.

BACKGROUND OF THE INVENTION

The conventional sewing of a flap with a rough closing edge on a fabric part with a pocket placed on in advance is carried out, as is shown in FIGS. 4 and 5, in two partial steps. In a first partial step, the flap 10 with its rough closing edge 14, being in a rotated position in relation to the finished position of use 11, is aligned at a predetermined distance from the sewn-on pocket 9, taking into account the course of the pattern 17 of the fabric part, pocket and flap, and is connected to the fabric part 6 by means of a fastening seam 12. The flap 10 is then rotated by 180° into its position of use 11 around this fastening seam 12 in the second partial step and is connected to the fabric part 6 with a cover seam (top seam) 13, and the distance 15 between the cover seam 13 and the fastening seam 12 is selected to be such that the rough closing edge 14 of the flap 11 placed on in the finished position is no longer visible. This operation, which is carried out freely guided by hand, requires a high skill on the part of the seamstress to maintain the specified position of the flap 11 in relation to the pocket 9 and also to make the course 17 of the stripes or checks to be congruent within the specified tolerances in the case of figured fabrics. The process used here is extraordinarily time-consuming and requires a very large amount of training in order to meet the quality specifications and the required output.

A process and an automatic sewing machine for sewing a flap on a fabric part, in which the flap has a folded (clean) closing edge, is described in the patent DE 41 24 164 C2. In this case, the flap is pre-positioned in an offset parking position in relation to the pocket and is displaced into the position of use proper after the pocket has been sewn on, and is then sewn on. This process is not suitable for sewing on a flap with a rough closing edge for quality reasons, because the rough closing edge is visible after the flap has been sewn on.

SUMMARY AND OBJECTS OF THE INVENTION

The basic object of the present invention is to provide a process for sewing a flap with a rough closing edge together with a pocket on a fabric part in one operation and an automatic sewing machine for carrying out this process, in which the alignment and the sewing on of the flap with a rough closing edge are performed in a short time and with a simple device.

This object is accomplished according to the present invention in a process of the type described in the introduction by providing and positioning the flap with a rough closing edge in a rotated position in relation to a final position or "position of use" on the fabric part. The fabric part and the flap are then transported in fixed association with one another to a sewing machine with a sewing position. The flap is connected to the fabric part by means of a first flap seam. The flap is then rotated around the first flap seam into a final position, "position of use", and the flap is connected to the fabric part by means of a second flap seam at a distance spaced from said first flap seam.

The flap is aligned according to the pattern according to the fabric part inserted in advance and the positioned pocket cut in a rotated sew-on position in relation to its finished position of use relative to the fabric part and the pocket cut. The order of the alignment processes of the individual parts in relation to one another is extensively free. After folding the pocket cut and the sewing onto the fabric part, which may be a shirt part, a blouse part or a pant part, the positioned flap is sewn on with a first fastening seam and is then rotated into its position of use around this fastening seam, and it is subsequently connected to the fabric part by means of a cover seam such that the rough closing edge of the flap is no longer visible. As a result, a reduction in the overall processing time (process time and idle time) of the fabric part, pocket cut and flap through the manufacturing area is achieved, because operations that were previously carried out at separate workplaces are integrated in one clamping.

This leads to a reduction of the costs. At the same time, this leads to an improvement in quality, because the risk of the flap not having an exact position relative to the pocket cut and the fabric part after the alignment process is reduced due to the clamped guiding of the seam.

An automatic sewing machine only connecting the flap and not positioning or connecting the pocket cut is also provided for carrying out the process. Contrary to the currently known positioning of a pocket cut in relation to a fabric part and the subsequent folding of the pocket cut and the sewing of these two parts, only the flap must be additionally inserted. The device is designed as such a flexible device that it can, of course, also be used when only pocket cuts without flaps are to be sewn on. The shape and the position of the fastening and cover seams by means of which the flap is fastened to the fabric part may be readily varied.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
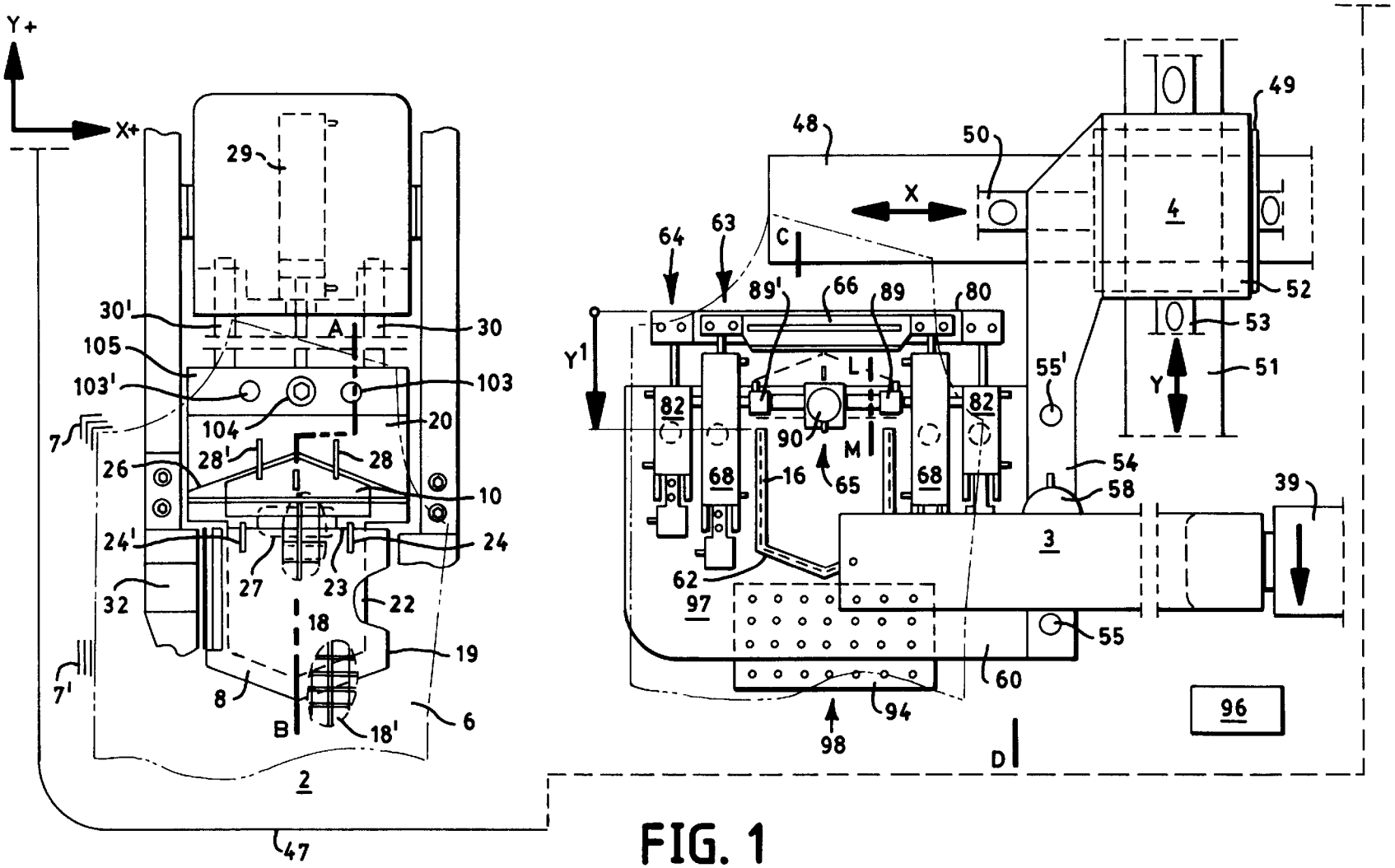
FIG. 1 is a partially cutaway representation of the top view of an automatic sewing machine according to the present invention.
Figure 2:
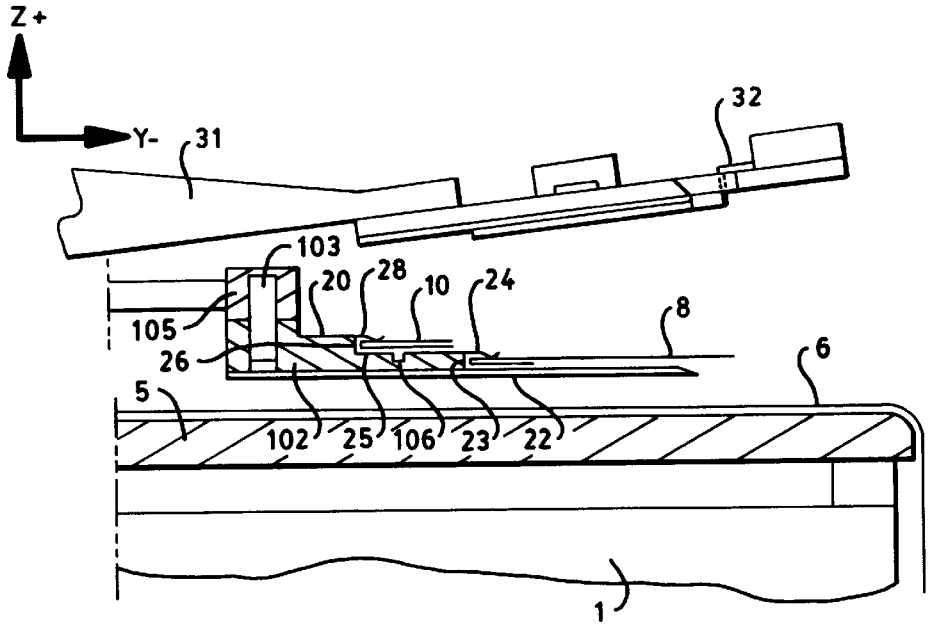
FIG. 2 is a side view A-B of the preparation station (loading station) 2 with the folding device.

The automatic sewing machine shown in FIGS. 1 and 2 has a frame 1, on which a preparation station with a folding device 2 (loading station), a sewing machine 3, and a fabric guide unit 4 is stationarily arranged. The fabric part 6, which may be, e.g., a shirt front part, is positioned in the preparation station 2 on the fabric support plate 5 according to corresponding line marks 7 and 7'. The pocket cut 8 is positioned on a thin folding plate 22 made of spring steel at the stop 23, aligned with the fabric part 6 according to the pattern, and is held in the position necessary for folding and sewing in relation to the fabric part 6 by the elastic clamps 24 and 24'. For the alignment according to pattern of the fabric parts in relation to one another, the folding plate 22 is perforated by a window 27, through which the course of the pattern 18 of the fabric parts to be sewn together can be traced. The folding device or tools 32, which are necessary for folding the pocket cut 8, are shown only partially, and by means of which the pocket cut 8 is folded and positioned in the correct position on the lower fabric part 6, are accommodated in the support 31 projecting freely over the fabric support 5. Such folding devices have been generally known and are widespread in practice, so that a detailed description is not necessary. The following documents may be referred to as examples: DE 37 09 264 A1 (corresponding to U.S. Pat. No. 4,813,362), DE 37 09 210 A1 (corresponding to U.S. Pat. No. 4,793,272), and DE 37 09 251 A1 (corresponding to U.S. Pat. No. 4,785,749), and incorporated by reference.

The folding plate 22 is connected to a step-like positioning support 102 to form a changing unit, which is fastened to the guide support 105 via the pins 103 and 103' by means of the screw 104. In its sew-on position, which is rotated by 180° in relation to its finished position of use, the flap 10 is aligned on the positioning surface 25 with the fabric part 6 and the pocket cut 8 according to the pattern at the stop 26 and is held in position by the elastic clamps 28 and 28'.

Figure 3:
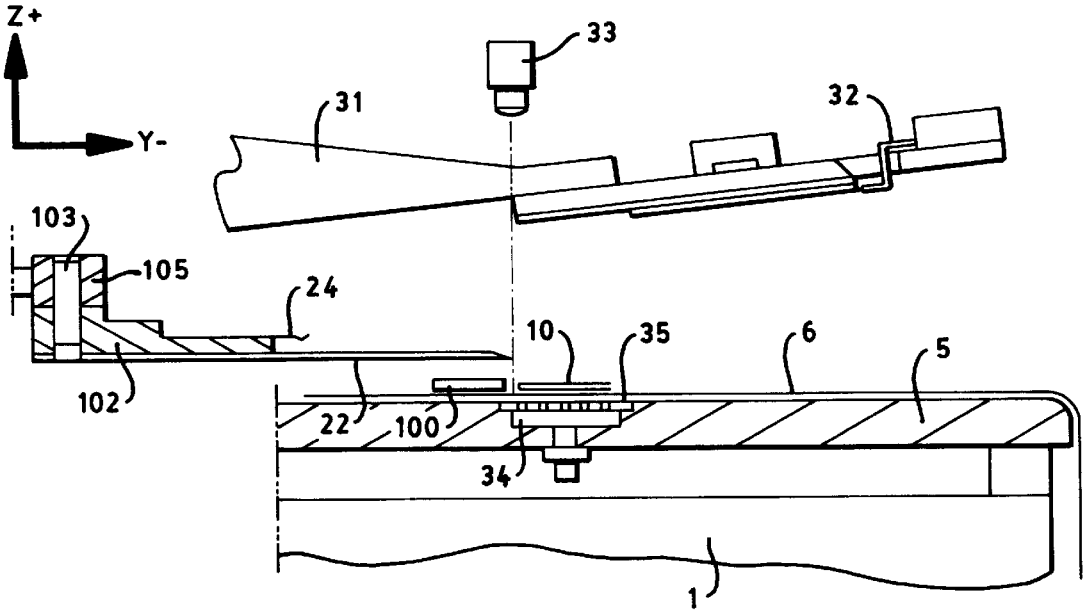
FIG. 3 is the side view A-B of a variant of the preparation station 2 with the folding device.
Figure 4:
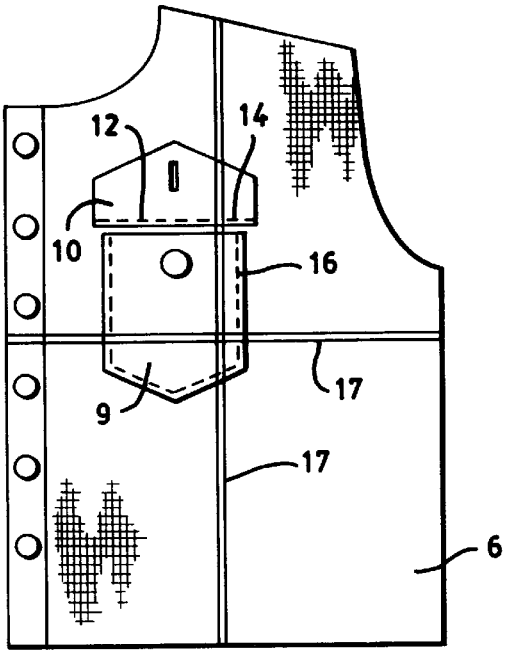
FIG. 4 is a shirt with the pocket and flap sewn on in the rotated position with the fastening seam.

FIG. 3 shows another possibility of positioning the flap 10 in relation to the fabric part 6. In this case, the folding plate 22 is withdrawn by means of the cylinder 29 and the fabric part 6 is aligned as was described above. The flap 10 is then aligned in its sewn-on position, which is rotated by 180° in relation to its finished position of use, at the fabric part 6 at two light marks emitted by two light radiators 33, taking into account the course of the pattern, and is sectioned by a vacuum chamber 34 over a perforated plate 35. In the next step, the folding plate 22 is again withdrawn into its starting position, and the pocket cut 8 is positioned as was likewise described above. Instead of the light marks, it is also possible to use a movable stop 100, at which the flap 10 is positioned and then moved out of the folding area of the folding device 32.

Figure 6A:
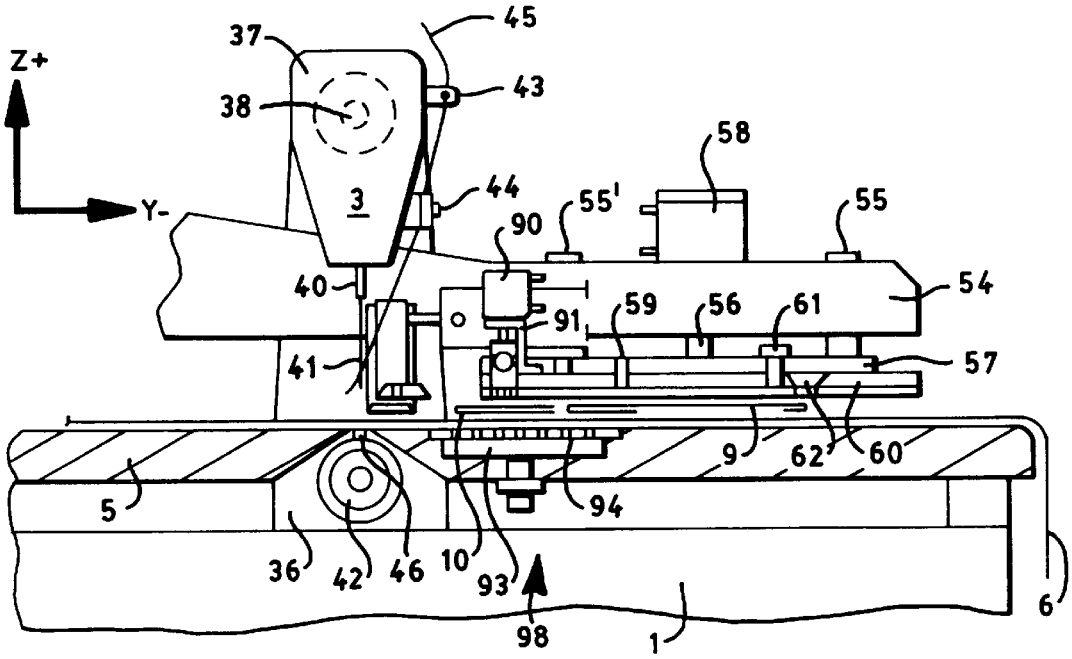
FIG. 6*a* is a side view of the fabric holder and sewing machine in a sectional representation C-D.
Figure 6B:
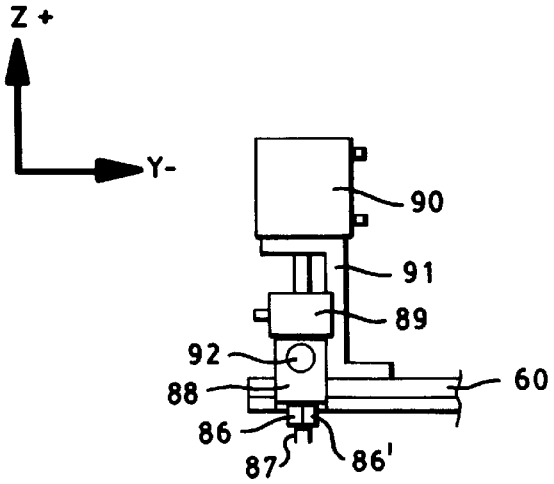
FIG. 6*b* is the flap-gripping system in a sectional representation along L-M.

As is shown in FIG. 6, the sewing machine 3 comprises, in the usual design, a base plate 36 having a cylinder arm design and an upper arm 37, in which an arm shaft 38 is mounted, which is driven by an electronically controlled motor 39. The drive of the needle bar 40 with the needle 41 and also the drive of a hook 42 located in the base plate 36 are derived from the arm shaft 38 in the usual manner. A thread 45 is fed to the needle 41 via a thread take-up lever 43 and a thread tensioner 44, and the thread is gripped by the shuttle 42 when the needle 41 dips into the base plate 36 through a stitch hole 46 and is connected to a lower thread, not shown, to form a double-thread lock stitch.

Above the fabric support plate 5 (FIG. 1 and FIG. 6), a fabric guide means 4, which is arranged behind the sewing machine 3 when viewed from the operator's side 47, is provided for the fabric parts 6, 8, 10 to be sewn together. It has a guide rail 48, which is rigidly connected to the frame 1 above the fabric support plate 5. A guide carriage 49 is driven on the guide rail 48 in the X direction via a toothed belt 50 by a computer-controlled motor (not shown here). The guide rail 51, on which the guide carriage 52 is moved in the Y direction by a computer-controlled motor (not shown here) via a toothed belt 53, is rigidly connected to the guide carriage 49 for the movement in the X direction. The guide rail 48 with the guide carriage 49 for the movement in the X direction and the guide rail 51 with the guide carriage 52 for the movement in the Y direction form a mobile rectangular system of coordinates, with which any amount of travel can be performed in the known manner by means of a computer-controlled program (CNC) with the control unit 96. The Y carriage 52 is provided with a bracket 54, in which two guide rails 55 and 55' slide. The guide bars 55 and 55' are connected to the connecting support 57 to form a guide unit. This guide unit is actuated by the compressed air-controlled lifting cylinder 58, which is fastened to the bracket 54 on the one side and is connected to the connecting support 57 at its piston rod 56. A fabric holder 60 is positioned at the connecting support 57 by means of straight pins 59 and is fastened by means of screws 61, and the fabric holder is perforated by a groove 62, which corresponds to the course of the seam of the pocket contour 16 to be sewn.

To sew the flap 10 on the fabric part 6, the fabric holder 60 is equipped with a turning slide system 63, a folding slide system 64, and a flap-gripping system 65.

Figure 7:
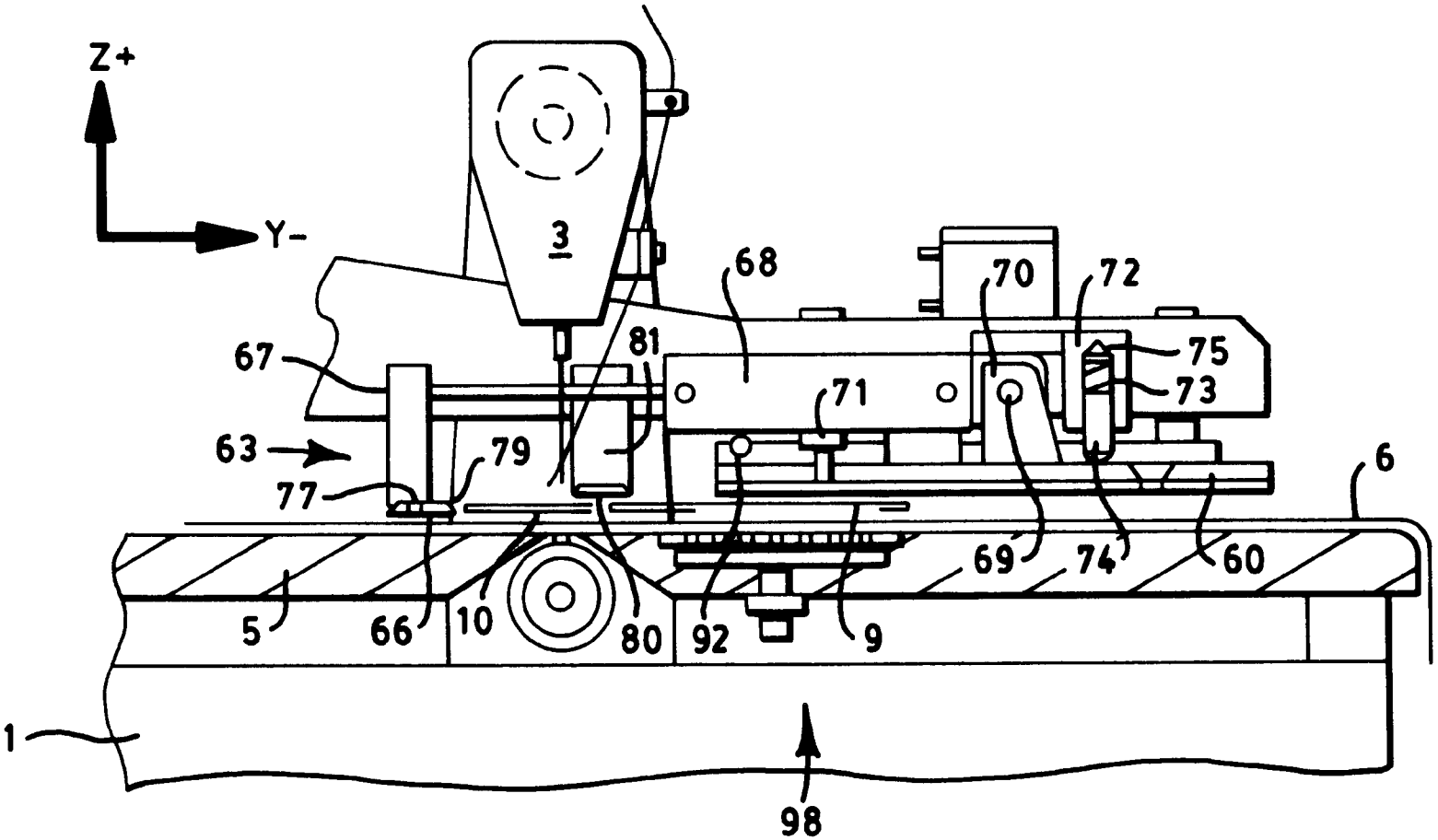
FIG. 7 is the side view (sectional representation E-F) of the fabric holder with the turning slide extended.
Figure 8:
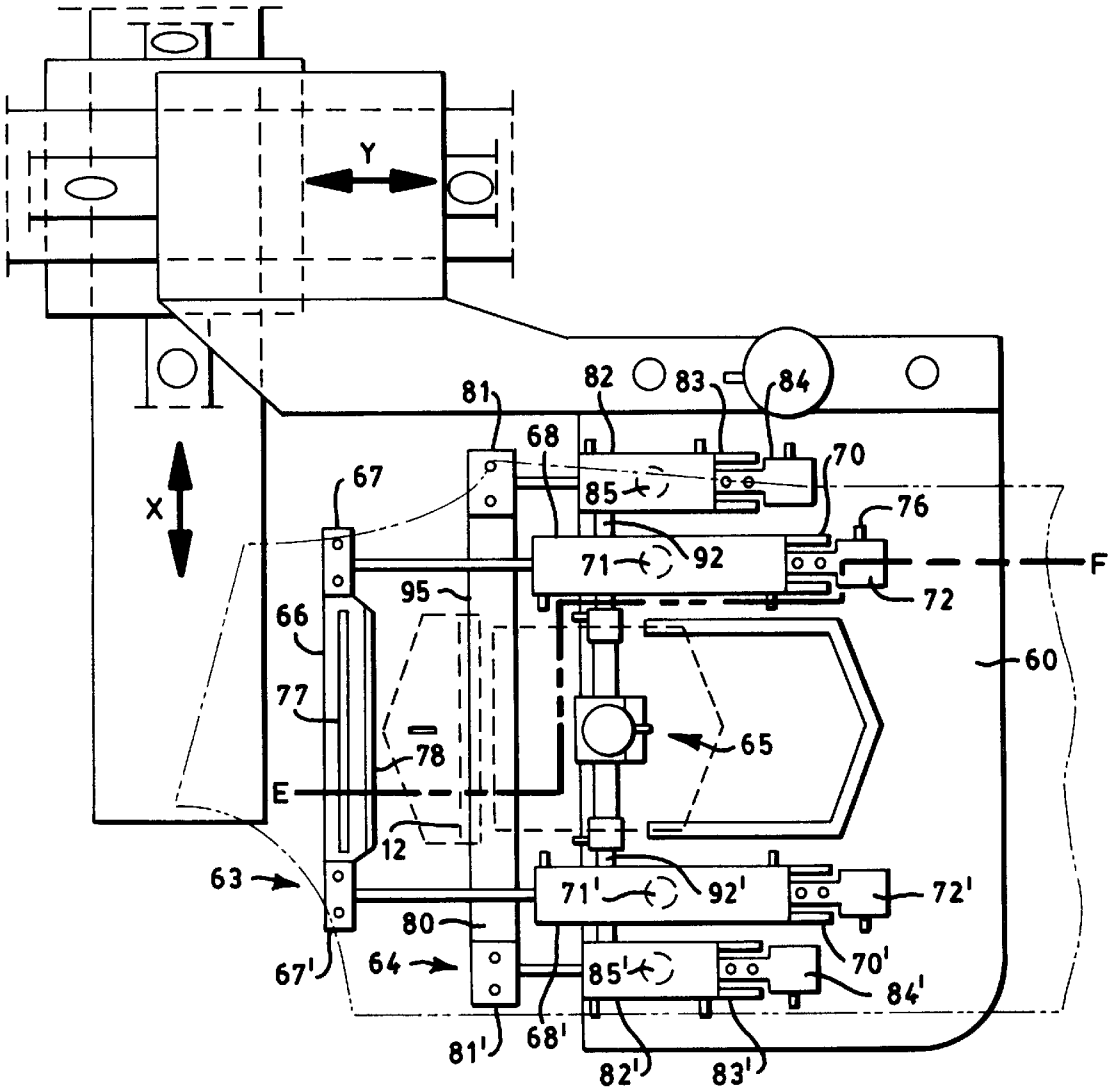
FIG. 8 is the top view of the fabric holder with the turning slide extended.

The turning slide system 63, see FIG. 7 and FIG. 8, comprises a turning strip 66, which is fastened to the cylinder clamping pieces 67 and 67', to which the piston rods of the cylinders or turning strip drives 68 and 68' are connected to form a displacing unit. The cylinders 68 and 68' are mounted at their end rotatably around the pin 69 in fork-shaped bearing blocks 70 and 70', which are fastened to the fabric holder 60. The exact height position of the turning strip 63 relative to the fabric support plate 5 is set by the adjusting elements 71 and 71', at which the cylinders 68 and 68' are supported. The pressing systems 72 and 72', which press down the entire set turning slide system 63 against the adjusting elements 71 and 71' with the springs 73 and 73', on the one hand, and permit the turning strips 66 to be raised during crossing over thickened parts of the fabric, on the other hand, are arranged at the cylinders 68 and 68' on the opposite side of the pin 69. The spring pressure of the pressing system 72 and 72' is transmitted to the cylinders 68 and 68' via the bolt 74. To increase the action of the pressing force, the bolt 74 may be designed as a piston, and controlled compressed air may be admitted to the spring chamber 75 via the inlet 76. The turning strip 66 is provided with a slot 77 for sewing the cover seam 13 and is provided with a tapering chamfer 79 along the turning edge 78 to improve movement under the pocket flap 10 and the subsequent turning around the folding strip 80.

The folding slide system 64 has a design similar to that of the turning slide system 63. The folding strip 80 is fastened to the cylinder clamping pieces 81 and 81', which are in turn connected to the piston rods of the cylinders or folding strip drive means 82 and 82' to form one unit. The cylinders 82 and 82' are fastened to the fabric holder 60 similarly to the fastening of the turning slide system via the fork-shaped bearing blocks 83 and 83', in which the cylinders are mounted rotatably. The pressing systems 84 and 84' press the cylinders 82 and 82' against the adjusting elements 85 and 85', which are set such that the necessary pressing pressure for sewing the fastening seam 12 is brought about when the folding strip 80 is placed on the flap 10.

The flap-gripping system 65 (FIG. 1, FIG. 6*a* and FIG. 6*b*) comprises a guide housing 88, in which two needle bars 86 and 86' moving in opposite directions are actuated by the needle cylinders 89 and 89'. Due to the alternating actuation of the cylinders 89 and 89', the needle bars 86 and 86' are displaced in the downward direction according to the known principle and penetrate with the needles 87 into the fabric of the flap 10 in the process to pick this up as a part of the fabric holder 60.

Instead of the needle gripper, it is also possible to use a vacuum gripper, which does not leave behind any damage on the fabric during the processing of delicate fabrics.

The guide housing 88 is moved up and down in a slot in the fabric holder 60 by the fabric holder cylinder 90, which is fastened to the fabric holder 60 via the cylinder holder 91. Two fabric holder rods 92 and 92', which extend under the cylinders 68, 68', 82 and 82' and raise same when the fabric holder 60 is placed on the folding plate 22 in the loading station 2 and during the return of the folding plate 22 from the folding position, so that a soft, trouble-free process is guaranteed during the transfer of the fabric parts to be sewn from the loading station 2 to the sewing machine 3, are fastened to the guide housing 88. To protect the needles from damage in the extended position in the loading position 2, the flap support surface 25 is provided with a groove 106 (FIG. 2), into which the needle tips passing through can penetrate.

The mode of operation is as follows:

A fabric part 6, here a shirt front part, is placed on the fabric support plate 5 under the folding device of the loading station 2 (FIG. 1 and FIG. 2) and is aligned at the line marks 7 and 7' as was described above, while the folding plate 22 is in an extended position brought about by the folding plate cylinder 29 above the fabric part 6. The pocket cut 8 is then placed on the folding plate 22 and pushed against the stop 23 and is positioned there according to the pattern and is held at the same time by means of the clamps 24 and 24'. The flap 10 is placed on the positioning surface 25 in the same manner, is pushed into the sew-on position against the stop 26, and is aligned according to the pattern, as a result of which it is held by the clamps 28 and 28' at the same time.

The pocket cut 8 is then folded by means of folding tools 32, which are shown only partially, i.e., its edge 19 is folded over on the underside of the folding plate 22. The folding plate 22 is subsequently lowered together with the folding tools 32 shown only partially onto the fabric part 6 located on the fabric support plate 5. The folding tools 32 are separated from the folding plate 22 and are pivoted upward as a whole with the folding tool support 31 and moved away to the rear. With the exception of the placement of the positioning surface 25 and the flap 10 in a rotated sew-on position and of the rough closing edge on the folding plate 22, this procedure has been known from the above-mentioned DE 37 09 251 A1 (corresponding to U.S. Pat. No. 4,813,362), DE 37 09 251 A1 (corresponding to U.S. Pat. No. 4,785,749) and DE 37 09 210 A1 (corresponding to U.S. Pat. No. 4,793,272), which may thus be referred to.

The fabric holder 60 (FIG. 1, FIG. 2, FIG. 6*a* and FIG. 6*b*) with the turning slide system 63 arranged on it, with the folding slide system 64 and the flap-gripping system 65 is moved into the loading station 2, located on the left in FIG. 1, in the raised position (with the cylinders 58 and 90 withdrawn) via the guide carriages 49 (for the X axis) and 52 (for the Y axis) with the associated toothed belts 50 and 53 by means of computer-controlled motors (not shown here) for the X and Y axes. In this position, in which the slot 62 assumes an exact position relative to the folded pocket 9, the fabric holder 60 is lowered onto the folding plate 22 by reversing the movement of the cylinder 58, and the folded pocket 9 with the fabric part 6 is pressed against the fabric support plate 5. The movement of the cylinder 90 for the flap-gripping system 65 is then reversed, and it lowers the turning strip 66 and the folding strip 80 onto the support surface 20 and the guide housing 88 with the needle bars 86 and 86' onto the flap 10. The cylinders 89 and 89' are actuated in this position, as a result of which the needle bars 86 and 86' with the needles 87 are extended, and they penetrate into the flap 10. By reversing the movement of the cylinder 90 again (cylinder 90 withdrawn), the flap 10 gripped with the needle bars 86 and 86' is raised from the positioning surface 25, as the turning strip 66 and the folding strip 80 are also raised from the support surface 20 via the rods 92 and 92'. The folding plate 22, which is under the pressure of the fabric holder 60 and presses the folded pocket 9 with the fabric part 6 against the fabric support plate 5, is then pulled out under the fabric holder 60 together with the support surfaces 20 and 25 and the clamps 24, 24' and 28, 28' by reversing the movement of the cylinder 29, and the folded pocket 9 and the flap 10 remain in a fixed position relative to the fabric part 6 in their above-described sew-on position. The fabric holder 60 with the three fabric parts 6, 9 and 10 is subsequently transferred from the loading station 2 to the sewing machine 3 by means of the fabric guide system 4, and the movement of the cylinder 90 of the flap-gripping system is again reversed during this movement, and it lowers the gripped flap 10 with the needle bars 86 and 86' onto the fabric part 6 and holds it non-displaceably in the predetermined sew-on position. The turning strip 66 and the folding strip 80 are also lowered to the level predetermined by the adjusting elements 71, 71' and 85, 85' by reversing the movement of the cylinder 90. The seam 16, by means of which the folded pocket 9 is connected to the fabric part 6, is then sewn in the usual manner.

After this sewing process, the fabric parts 6, 9 and 10 are pushed by means of the fabric holder 60 over the vacuum chamber 93 of the fabric-holding means 98. By correspondingly admitting vacuum to the vacuum chamber 93, the three fabric parts 6, 9 and 10 are suctioned over the perforated plate 94 and are held in a fixed position on the fabric support plate 5. The movement of the cylinders 89 and 89' is reversed in this position, so that the needle bars 86 and 86' release the flap 10, and the fabric holder 60 is raised by reversing the movement of the cylinder 58.

The fabric holder 60 is moved from this raised position from the pocket sew-on position into the flap sew-on position by a corresponding drive of the Y carriage 52 by a predetermined amount Y1 in the negative Y direction, so that the folding edge 95 of the folding slide 80 comes down in the vicinity of the fastening seam 12 after the lowering of the fabric holder 60 onto the fabric parts 6, 9 and 10 and presses the flap 10 down against the fabric support plate 5 for sewing the fastening seam 12 (FIG. 7 and FIG. 8).

Figure 5A:
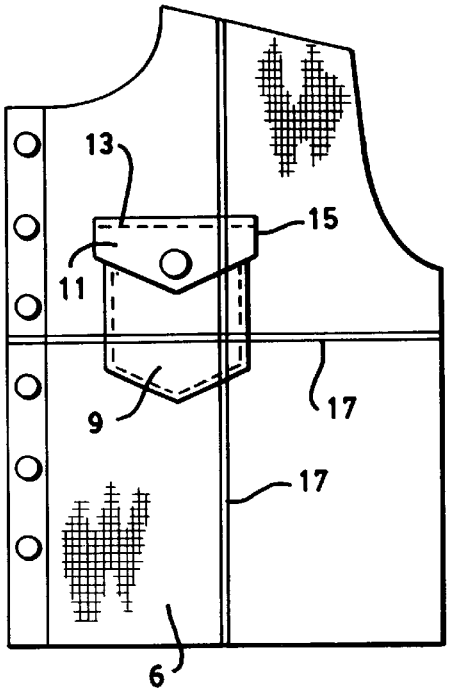
FIG. 5*a* is a shirt with the pocket and flap sewn on in the position of use with the cover seam.
Figure 5B:
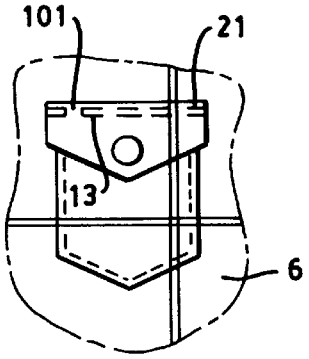
FIG. 5*b* is the pocket and flap in the position of use with two cover seams and pencil opening (design variant to FIG. 5)

The turning strip 66 is extended at this point in time at the latest into the position shown in FIGS. 7 and 8 by reversing the movement of the turning slide cylinders 68 and 68'. The sewing of the fastening seam 12, whose course can be freely selected, e.g., with a seam interruption for a pencil opening 101 (FIG. 5*b*), is performed thereafter.

Figure 9:
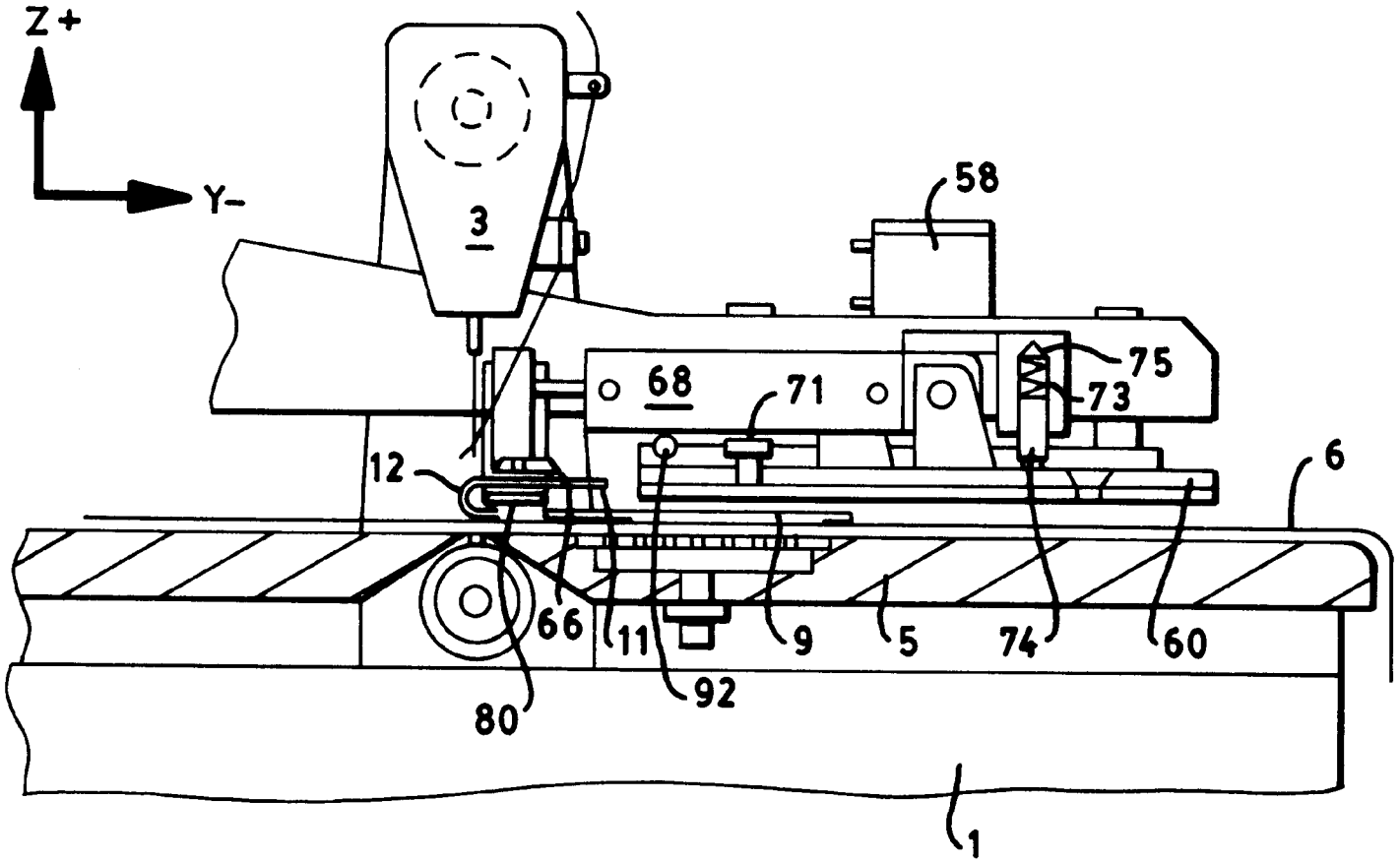
FIG. 9 is the side view (sectional representation G-H) of the fabric holder with the turning slide withdrawn.
Figure 10:
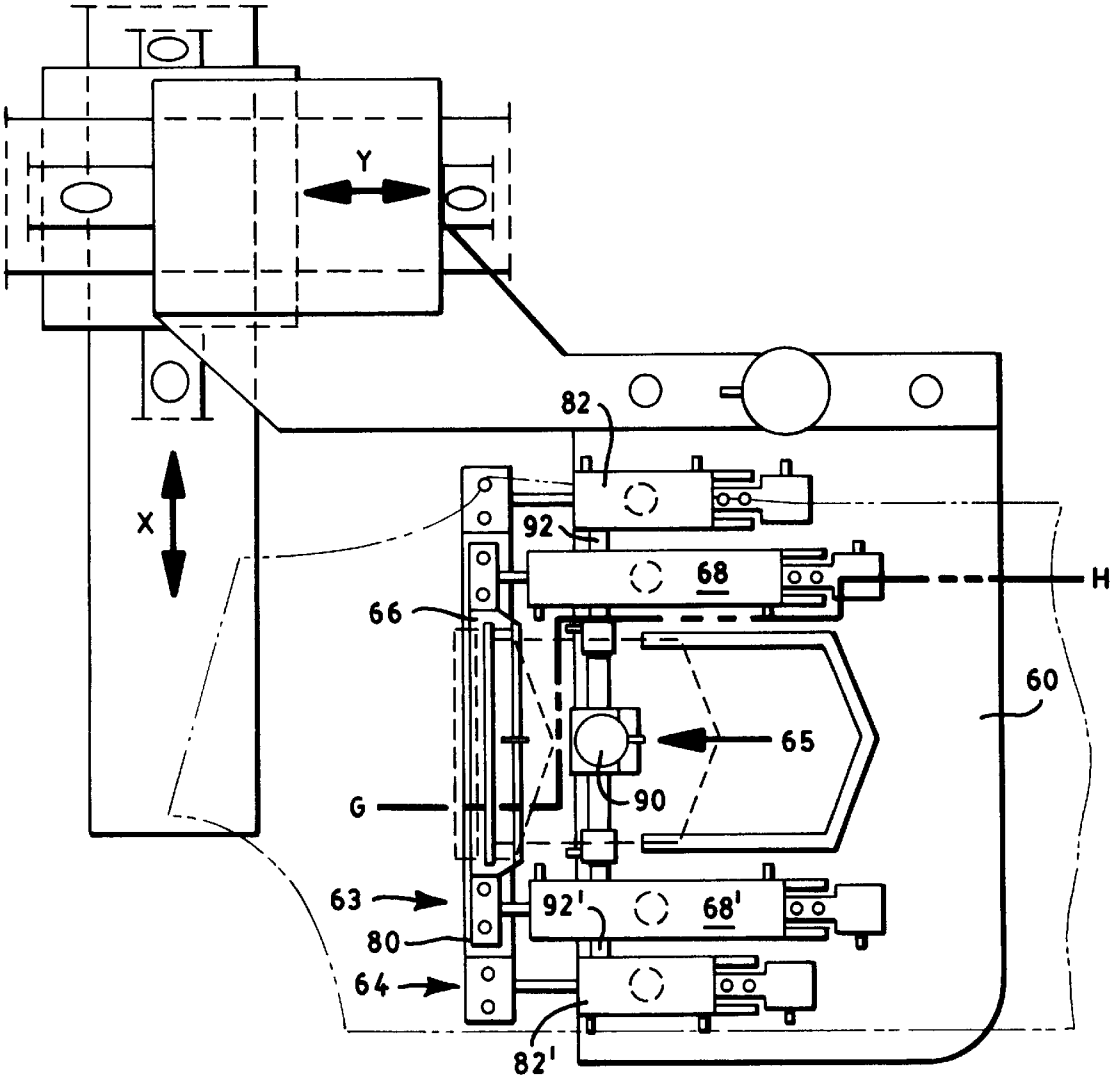
FIG. 10 is the top view of the fabric holder with the turning slide withdrawn.

After the fastening seam 12 has been prepared, the movement of the turning slide cylinders 68 and 68' is reversed, and these cylinders move the turning strip 66 under the flap 10 to the fastening seam 12, which is located in the immediate vicinity of the folding strip 80. The turning strip 66 and thus also the flap 10 are raised during this movement (FIG. 9 and FIG. 10) approximately to the level of the folding strip 80 by slightly tilting the angle of the cylinders 68 and 68' in relation to the fabric support plate 5.

At the fastening seam 12, the turning strip 66, which continues to move toward its end position, abuts the folding strip 80, with which it comes into contact, and it rotates the flap 10 by 180° around the fastening seam 12 and the folding edge 95 of the folding strip 80 into its final position of use 11. Due to the folding strip 80 being in the immediate vicinity of the fastening seam 12, an exact rotation and consequently also folding of the flap 10 around the folding edge 95 into its position of use 11 by means of the turning strip 66 is guaranteed with all fabric grades.

Figure 11:
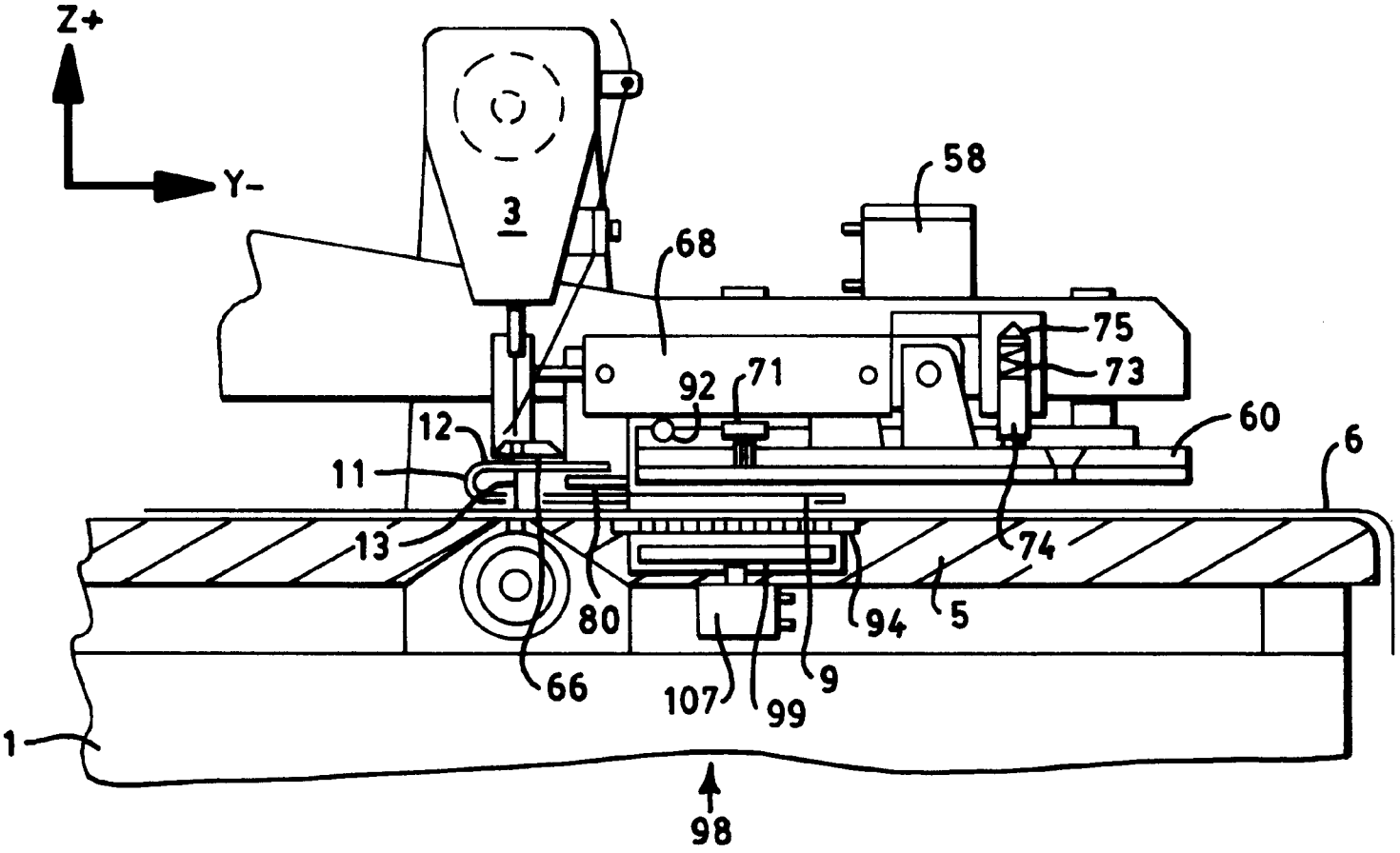
FIG. 11 is the side view (sectional representation I-K) of the fabric holder with the folding slide withdrawn.
Figure 12:
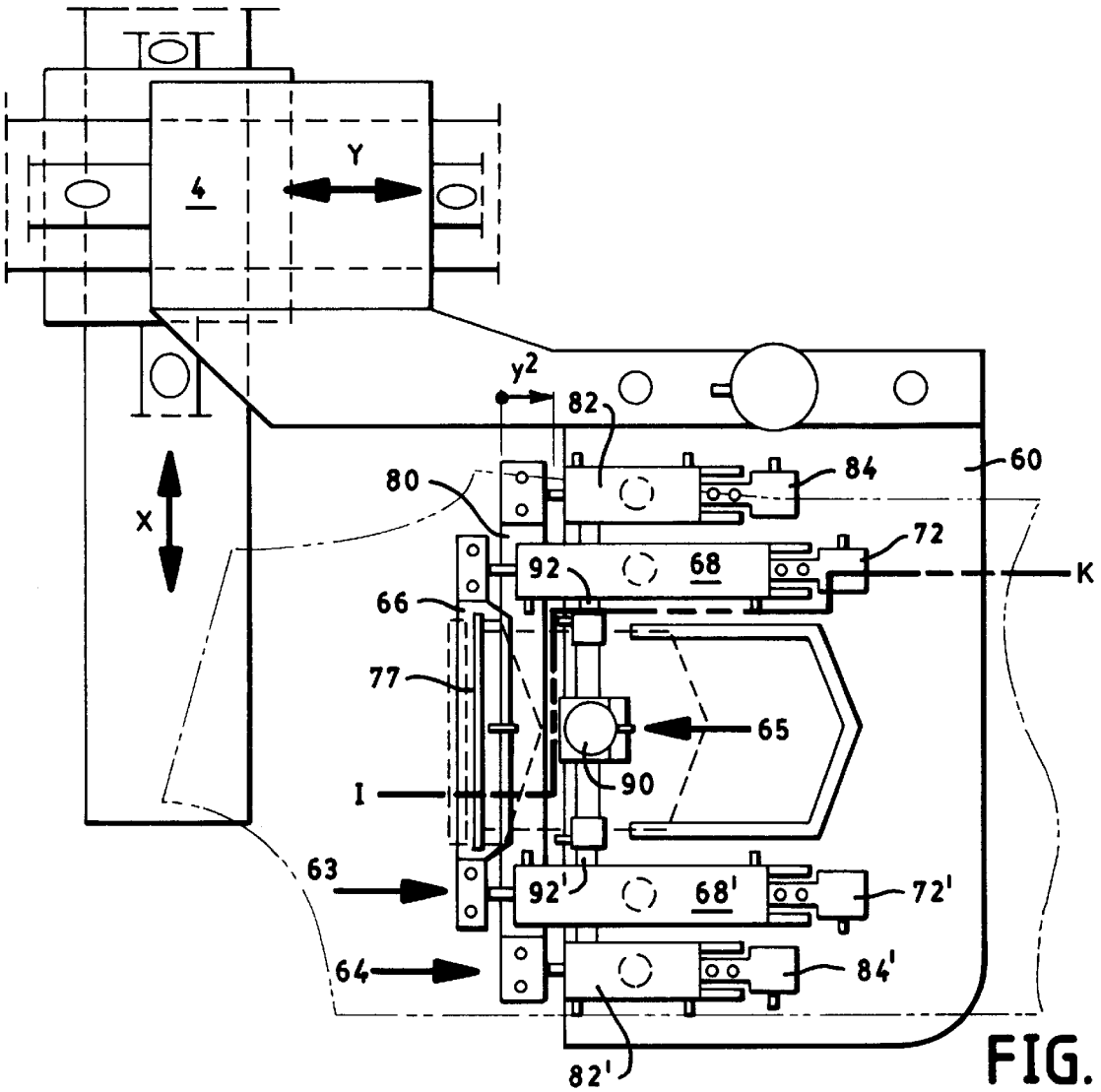
FIG. 12 is the top view of the fabric holder with the folding slide withdrawn.

After the turning strip 66 has reached its new end position, the movement of the folding slide cylinders 82 and 82' is reversed, and the folding strip 80 is withdrawn into its new end position, as is shown in FIGS. 11 and 12, and it releases the flap 11 for sewing the cover seam 13. After the folding strip 80 has reached its new position, the turning strip 66 presses the flap 11 against the fabric support plate 5 by means of the pressing systems 72 and 72'. In this state, the flap is connected in its position of use 11 to the fabric part 6 through the slot 77 of the turning strip by means of the cover seam 13.

After the conclusion of this sewing process, the fabric holder 60 is raised by reversing the movement of the cylinder 58, and the Y carriage 52 is displaced by a section Y2 to the extent that the folding strip 80 is no longer covered by the flap 11. The unstacking of the fabric parts 6, 9 and 11 sewn together, which will begin thereafter, can thus take place in a trouble-free manner. During the sewing process, which takes place automatically, the operator can again place new fabric parts into the preparation station 2 in the above-described manner. These new fabric parts will be sewn after the finished, sewn fabric parts 6, 9 and 11 have been unstacked and the fabric holder 60 has been returned into the loading position 2.

The sewing on of pocket flaps with two cover seams is also performed in practice for design reasons. This variant (FIG. 5*b*) can also be carried out with the above-described device. The flap 10 is rotated now into its position of use 11 around the folding strip 80, without sewing the fastening seam 12, and is subsequently sewn to the fabric part 6 with two cover seams 13 and 21, as is shown in FIG. 11. The course of these seams may be freely selected, e.g., with a seam interruption 101 for a pencil opening.

To hold the fabric parts 6, 9 and 10 in the fabric-holding means 98, a needle bar 99 may also be used during the transfer of the fabric holder 60 from the pocket sew-on position into the flap sew-on position, wherein the needle bar 99 penetrates into the fabric of these fabric parts due to actuation of the cylinder or needle drive 107 via the perforated plate 94 and holds these fabric parts in a fixed position on the fabric support plate 5.

As an alternative, this process and this automatic sewing machine may also be used to sew on flaps on clothes in the manner described here, which have no pockets for reasons of fashion or on which the pockets must be sewn on according to another manufacturing process for manufacturing technical reasons.

All drives, motors and cylinders with the solenoid valves associated with them are actuated via a programmable control 96.

The features described in specification, drawings, abstract, and claims, can be used individually and in arbitrary combinations for practicing the present invention.

While specific embodiments of the invention have been shown and described in detail to illustrate the application of the principles of the invention, it will be understood that the invention may be embodied otherwise without departing from such principles.

What is claimed is:

1. Process for sewing a flap pocket on a fabric part by means of an automatic sewing machine, the process comprising the steps of:

providing a flap;

positioning the flap with a rough closing edge in a rotated position in relation to a final position, known as a position of use, on the fabric part;

transporting the fabric part and the flap in a fixed association with one another to a sewing position;

connecting the flap to the fabric part by means of a first flap seam;

rotating the flap around said first flap seam into said final position, known as a position of use, and connecting the flap to the fabric part by means of a second flap seam at a distance spaced from said first flap seam.

2. Process in accordance with claim 1, further comprising:

providing a folding strip positioned spaced from said first flap seam;

providing a turning strip and said rotating of the flap being performed by moving said turning strip relative to the flap and said folding strip.

3. Process in accordance with claim 1, further comprising:

providing a pocket cut for the pocket flap;

folding and positioning the pocket cut at a predetermined distance from the flap on the fabric part;

transporting said folded pocket cut simultaneously with said transporting of said flap and said fabric part;

connecting the folded pocket and the said fabric part to one another in said sewing position by means of a pocket seam.

4. Process for sewing a flap on a fabric part by means of an automatic sewing machine, the process comprising the steps of:

positioning the flap with a rough closing edge in a rotated position in relation to a final position, known as a position of use, on the fabric part;

transporting the fabric part and the flap in a fixed association with one another to a sewing position;

providing a folding strip positioned against the flap and holding the flap against the fabric part;

providing a turning strip on an opposite end of the flap from said folding strip connecting the flap to the fabric part by means of a first flap seam;

rotating the flap into said final position by moving said turning strip relative to the flap and said folding strip;

connecting the flap to the fabric part by means of a second flap seam.

5. Automatic sewing machine for sewing a flap pocket on a fabric part, the machine comprising:

a preparation station including a fabric support plate, a folding plate and a positioning support for a flap of the flap pocket and the fabric part;

a sewing machine with a sewing position;

a fabric holder with a flap-gripping system, a turning slide system and a folding slide system;

a fabric guide means for transporting said fabric holder from said preparation station into said sewing position of said sewing machine and for generating relative movement between said fabric holder and said sewing machine;

fabric-holding means for holding said flap to said fabric part when said fabric holder is removed from the fabric part at said sewing machine.

6. Automatic sewing machine in accordance with claim 5, wherein:

said turning slide system includes a turning strip displaceable by means of a turning strip drive.

7. Automatic sewing machine in accordance with claim 6, wherein:

said turning slide system includes a pin mounted in bearing blocks and said turning strip is mounted rotatably around said pin.

8. Automatic sewing machine in accordance with claim 6, wherein:

said fabric holder includes a folding strip and turning strip raising means for raising said turning strip to a level of said folding strip during a withdrawing movement.

9. Automatic sewing machine in accordance with claim 8, wherein:

said turning slide system includes adjusting elements for adjusting a height position of said turning strip in relation to said fabric support plate.

10. Automatic sewing machine in accordance with claim 6, wherein:

said turning slide system includes pressing system means for pressing said turning strip onto said flap for sewing a cover seam.

11. Automatic sewing machine in accordance with claim 10, wherein:

said pressing system means includes a piston chamber unit;

said pressing system means increases pressure on said turning strip by controlled admission of compressed air to said piston chamber unit.

12. Automatic sewing machine in accordance with claim 6, wherein:

said turning strip defines a slot for sewing a cover seam.

13. Automatic sewing machine in accordance with claim 6, wherein:

said turning strip is provided with a turning edge having an oblique chamfer.

14. Automatic sewing machine in accordance with claim 8, wherein:

said folding strip is displaceable by means of folding strip drive means.

15. Automatic sewing machine in accordance with claim 8, wherein:

said folding slide system includes bearing blocks and said folding strip is mounted rotatably in said bearing blocks.

16. Automatic sewing machine in accordance with claim 8, wherein:

said folding slide system includes adjusting elements for adjusting a height position of said folding strip in relation to said fabric support plate.

17. Automatic sewing machine in accordance with claim 8, wherein:

said folding slide system includes pressing system means for pressing said folding strip onto said flap for sewing a fastening seam.

18. Automatic sewing machine in accordance with claim 17, wherein:

said pressing system means of said folding slide system includes a piston chamber unit;

said pressing system means of said folding slide system increases pressure on said folding strip by controlled admission of compressed air to said piston chamber unit of said folding slide system pressing system means.

19. Automatic sewing machine in accordance with claim 5, wherein:

said fabric holder includes a fabric holder cylinder and fabric holder rods forming a means for said raising and lowering said turning slide system and said folding slide system.

20. Automatic sewing machine in accordance with claim 5, wherein:

said fabric-holding means includes a vacuum chamber with a perforated plate for holding the fabric part and the flap during transfer of said fabric holder from a pocket sew-on position into a flap sew-on position.

21. Automatic sewing machine in accordance with claim 20, wherein:

said fabric-holding means comprises an extensible needle bar, which is actuated by a needle drive.

22. Automatic sewing machine in accordance with claim 5, wherein:

said folding plate includes a support for a pocket cut and also includes a positioning surface for said flap.

23. Automatic sewing machine in accordance with claim 22, wherein:

said positioning surface includes a flap stop and a groove.

24. Automatic sewing machine in accordance with claims 23, wherein;

said folding plate and said positioning surface with said flap stop include clamps, and are designed as a composite component and are part of a folding device.

25. Automatic sewing machine in accordance with claim 5, wherein:

said flap is aligned directly on the fabric part according to light marks of a light radiator with said folding plate withdrawn.

26. Automatic sewing machine in accordance with claim 25, wherein:

said flap and the fabric part are held in position on the said fabric support plate by a vacuum chamber with a perforated plate.

27. Automatic sewing machine in accordance with claim 5, wherein:

said flap is aligned at a fixed stop.

28. Automatic sewing machine in accordance with claim 27, wherein:

said stop is movable out of a folding area of said folding device.

29. Automatic sewing machine in accordance with claim 5, wherein:

said flap-gripping system includes a guide housing with rods fastened to said guide housing.

30. Automatic sewing machine in accordance with claim 5, wherein:

said folding plate includes a positioning surface for said flap;

said flap-gripping system includes a guide housing movable up and down onto said flap-positioning surface and said fabric support plate by a fabric holder cylinder, said flap-gripping system also includes needle bars with needles that are withdrawn and extended by needle cylinders.

* * * * *